US009128448B2

(12) United States Patent
Maruta

(10) Patent No.: US 9,128,448 B2
(45) Date of Patent: Sep. 8, 2015

(54) IMAGE FORMING APPARATUS

(71) Applicant: KYOCERA DOCUMENT SOLUTIONS INC., Osaka-shi, Osaka (JP)

(72) Inventor: Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/226,687

(22) Filed: Mar. 26, 2014

(65) Prior Publication Data

US 2014/0294415 A1 Oct. 2, 2014

(30) Foreign Application Priority Data

Mar. 27, 2013 (JP) ..... 2013-065496

(51) Int. Cl.
*G03G 15/20* (2006.01)
*G03G 15/00* (2006.01)
*G03G 21/16* (2006.01)

(52) U.S. Cl.
CPC ..... *G03G 15/80* (2013.01); *G03G 15/2064* (2013.01); *G03G 21/1685* (2013.01); *G03G 15/2032* (2013.01); *G03G 2221/1657* (2013.01)

(58) Field of Classification Search
CPC ..... G03G 15/2067; G03G 15/2089; G03G 15/80; G03G 15/2064; G03G 21/1685
USPC ..... 399/67
See application file for complete search history.

(56) References Cited

U.S. PATENT DOCUMENTS 7,894,734 B2 2/2011 Sawamura et al.
2010/0086333 A1* 4/2010 Kim ..... 399/328

FOREIGN PATENT DOCUMENTS

JP 2007-025571 A 2/2007

* cited by examiner

*Primary Examiner* — David Bolduc
*Assistant Examiner* — Barnabas Fekete
(74) *Attorney, Agent, or Firm* — Studebaker & Brackett PC

(57) ABSTRACT

An image forming apparatus includes a fixing unit, an apparatus main body, a nip pressure changing member, a driving source, and a clutch mechanism. The fixing unit includes a first rotating member, a second rotating member, and a fixing nip forming mechanism. The fixing nip forming mechanism forms a fixing nip between the first rotating member and second rotating member. To the apparatus main body, the fixing unit is detachably installed. The nip pressure changing member presses the fixing nip forming mechanism and to change a pressure of the fixing nip by rotating around a rotation axis. The driving source rotates the nip pressure changing member. The clutch mechanism permits a transmission of a rotation from the driving source to the nip pressure changing member and restricts a transmission of a rotation from the nip pressure changing member to the driving source.

11 Claims, 16 Drawing Sheets

IMAGE FORMING APPARATUS

INCORPORATION BY REFERENCE

This application is based on and claims the benefit of priority from Japanese Patent application No. 2013-065496 filed on Mar. 27, 2013, the entire contents of which are incorporated herein by reference.

BACKGROUND

The present disclosure relates to an image forming apparatus comprising a fixing unit configured to fix a toner image on a sheet.

An electrographic image forming apparatus, such as a copying machine or a printer, comprises a fixing device configured to fix a toner image on a sheet. The fixing device includes a first rotating member (for example, a roller or a belt) heated by a heating source and a second rotating member (for example, a roller or a belt) forming a fixing nip between the first rotating member and second rotating member by being brought into pressure contact with the first rotating member. When the sheet passes through the fixing nip, the toner image is fixed on the sheet by heating and pressing the toner image.

In the above-mentioned fixing device, there is a fixing device unitized as a "fixing unit". The fixing unit is configured to be detachable to an apparatus main body of the image forming apparatus for the convenience of maintenance and part replacement.

In the above-mentioned fixing nip, the toner image may be fixed to various sheets with different thickness and dimensions. For instance, in a case where the toner image is fixed on a nonstandard sheet, such as an envelope or a thin paper, when a pressure (hereinafter, called as a "nip pressure") of the fixing nip is the same as that of another case where the toner image is fixed on a standard sheet, there is fear that the sheet is crinkled. In recent years, particularly, the sheet is diversified according to speeding up and colorization of the image forming apparatus, it is difficult that one nip pressure satisfies conveying performance and fixing performance to various types of the sheets.

Then, various mechanisms for changing the nip pressure in accordance with types of the sheets are being developed. For instance, there is a fixing unit including a compression spring that brings the first and second rotating members into pressure contact with each other and a nip pressure changing member that moves the second rotating member in a direction in which an inter-shaft distance from the first rotating member increases. In this art, the nip pressure changing member is provided with a gear which meshes with a gear on the apparatus main body side. The gear on the apparatus main body side is connected with a driving source provided in the apparatus main body.

In the art described above, the nip pressure changing member is provided in the fixing unit, enlarging and complicating the fixing unit. Still further, because the nip pressure changing member is provided in the fixing unit, the fixing unit inevitably receives a great load generated in changing the nip pressure, possibly receiving an excessive load.

In the abovementioned art, a rotation of the driving source provided in the apparatus main body is transmitted to the nip pressure changing member via the gear on the apparatus main body side and the gear on the nip pressure changing member side. According to this, there is a possibility of causing a tooth skipping between the gear on the apparatus main body side and the gear on the nip pressure changing member side and another possibility of malfunction due to an excessive axial torque applied to the gear on the apparatus main body side and the gear on the nip pressure changing member side.

Still further, in the abovementioned art, it is unable to rotate the nip pressure changing member without driving the driving source and it is difficult to rotate the nip pressure changing member when the driving source is stopped.

SUMMARY

In accordance with an embodiment of the present disclosure, an image forming apparatus includes a fixing unit, an apparatus main body, a nip pressure changing member, a driving source, and a clutch mechanism. The fixing unit includes a first rotating member, a second rotating member, and a fixing nip forming mechanism. The first rotating member is heated by a heating source. The second rotating member faces the first rotating member. The fixing nip forming mechanism forms a fixing nip between the first rotating member and second rotating member by bringing the second rotating member into pressure contact with the first rotating member. To the apparatus main body, the fixing unit is detachably installed. The nip pressure changing member is configured to press the fixing nip forming mechanism and to change a pressure of the fixing nip by rotating around a rotation axis. The driving source rotates the nip pressure changing member. The clutch mechanism is configured to permit a transmission of a rotation from the driving source to the nip pressure changing member and to restrict a transmission of a rotation from the nip pressure changing member to the driving source.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Figure 1:
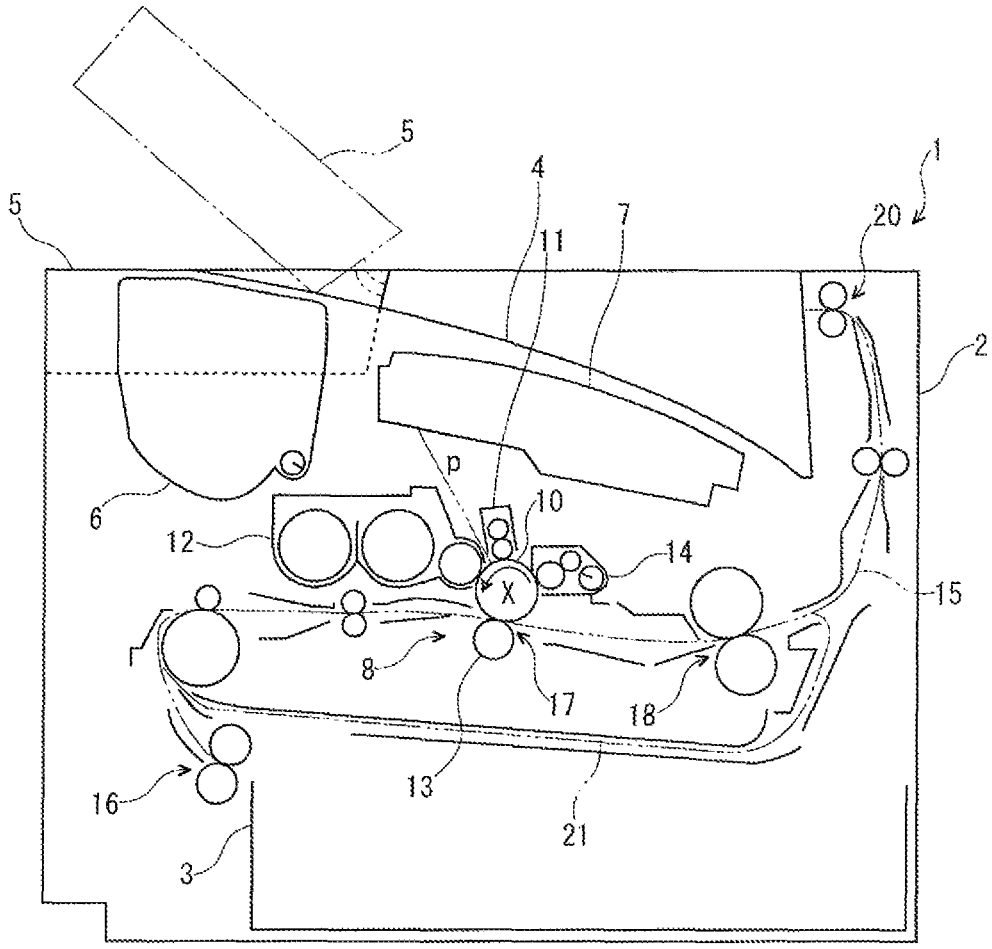
FIG. 1 is a schematic diagram schematically showing a printer according to an embodiment of the present disclosure.

With reference to FIG. 1, the entire structure of a printer 1 (an image forming apparatus) will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2 (an apparatus main body). In a lower part of the printer main body 2, a sheet feeding cartridge 3 configured to store sheets (not shown) is installed and, on the top surface of the printer main body 2, a sheet ejecting tray 4 is mounted. On the top surface of the printer main body 2, an upper cover 5 is openably/closably attached in front of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing unit 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing unit 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing unit 18, and then, the toner image is fixed on the sheet in the fixing unit 18. The sheet with the fixed toner image is ejected from the sheet ejecting unit 20 to the sheet ejecting tray 4. Toner remained on the photosensitive drum 10 is collected by the cleaning device 14.

Next, with reference to FIGS. 2-11, the printer main body 2 and fixing unit 18 will be described in detail. Arrow Fr suitably put on each figure indicates the front side of the printer 1. Because FIGS. 2-6, 9, and 10 are the back views, the left-hand and right-hand sides of the figure are converse to the actual left-hand and right-hand sides.

Figure 2:
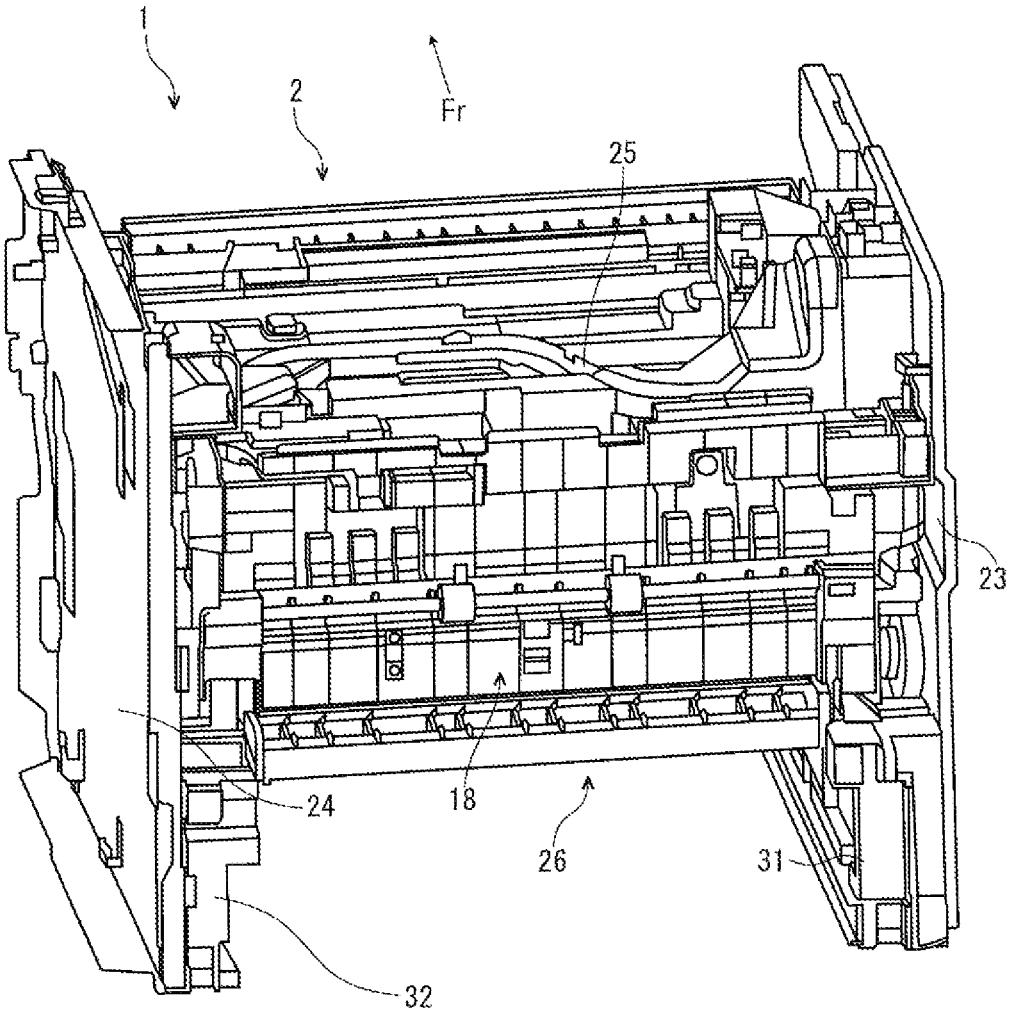
FIG. 2 is a perspective view showing a printer main body in a situation of installing a fixing unit in the printer according to the embodiment of the present disclosure.

First, the printer main body 2 will be described. As shown in FIG. 2, the printer main body 2 includes left and right main body frames 23 and 24 extending in the upper and lower direction, a center frame 25 bridged between upper parts of the left and right main body frames 23 and 24, and a conveying unit 26 bridged between the left and right main body frames 23 and 24 below the center frame 25.

Figure 3:
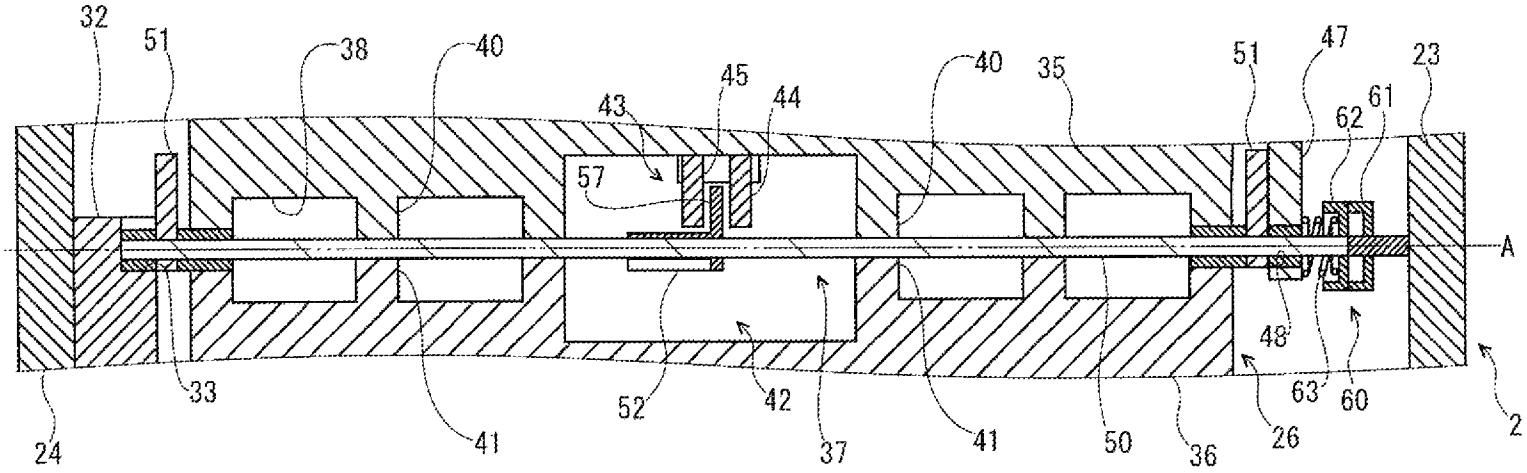
FIG. 3 is a sectional view showing the printer main body of the printer according to the embodiment of the present disclosure.
Figure 4:
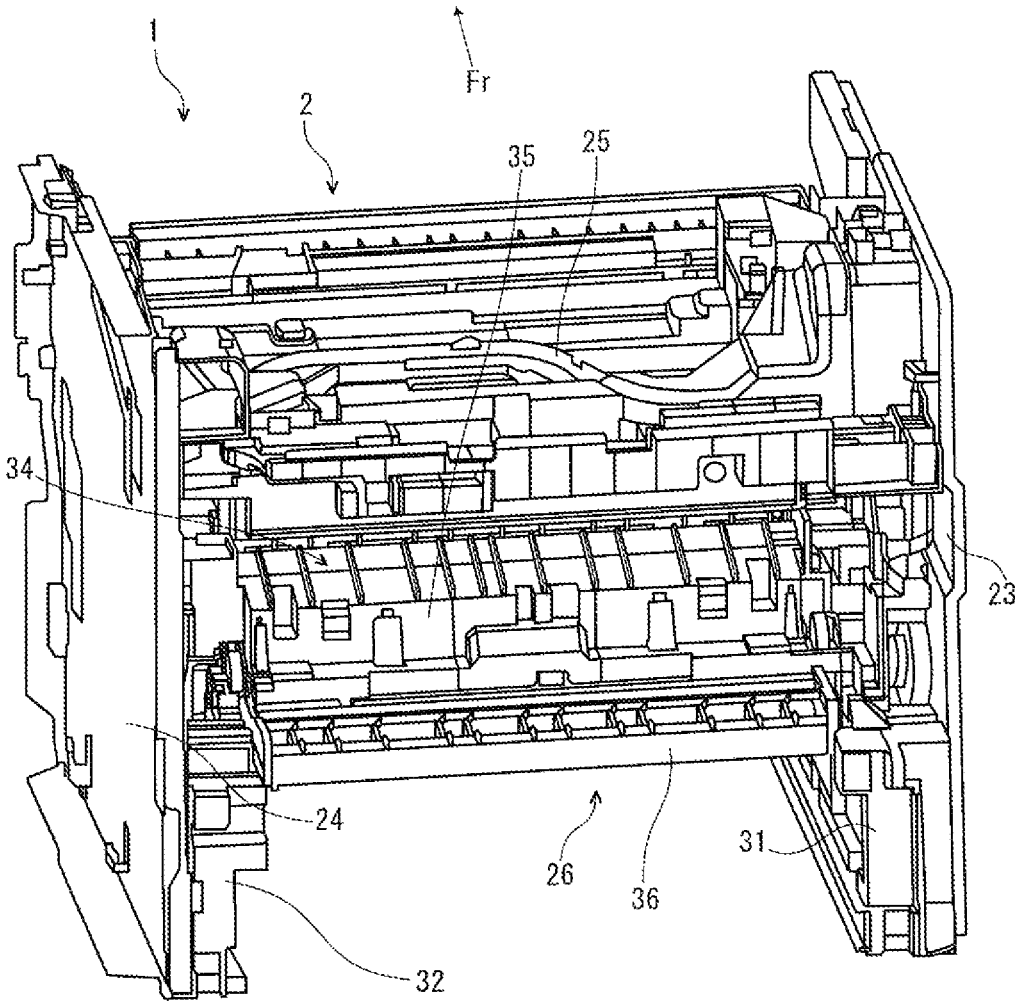
FIG. 4 is a perspective view showing the printer main body in a situation of detaching the fixing unit in the printer according to the embodiment of the present disclosure.

On a lower backward corner of the left main body frame 23, a left guide cassette 31 is attached. On a lower backward corner of the right main body frame 24, a right guide cassette 32 is attached. As shown in FIG. 3, in the right guide cassette 32, a depression-formed shaft supporting part 33 is formed. As shown in FIG. 4, between respective rear parts of the center frame 25 and conveying unit 26, a fixing unit installed part 34 is arranged.

Figure 5:
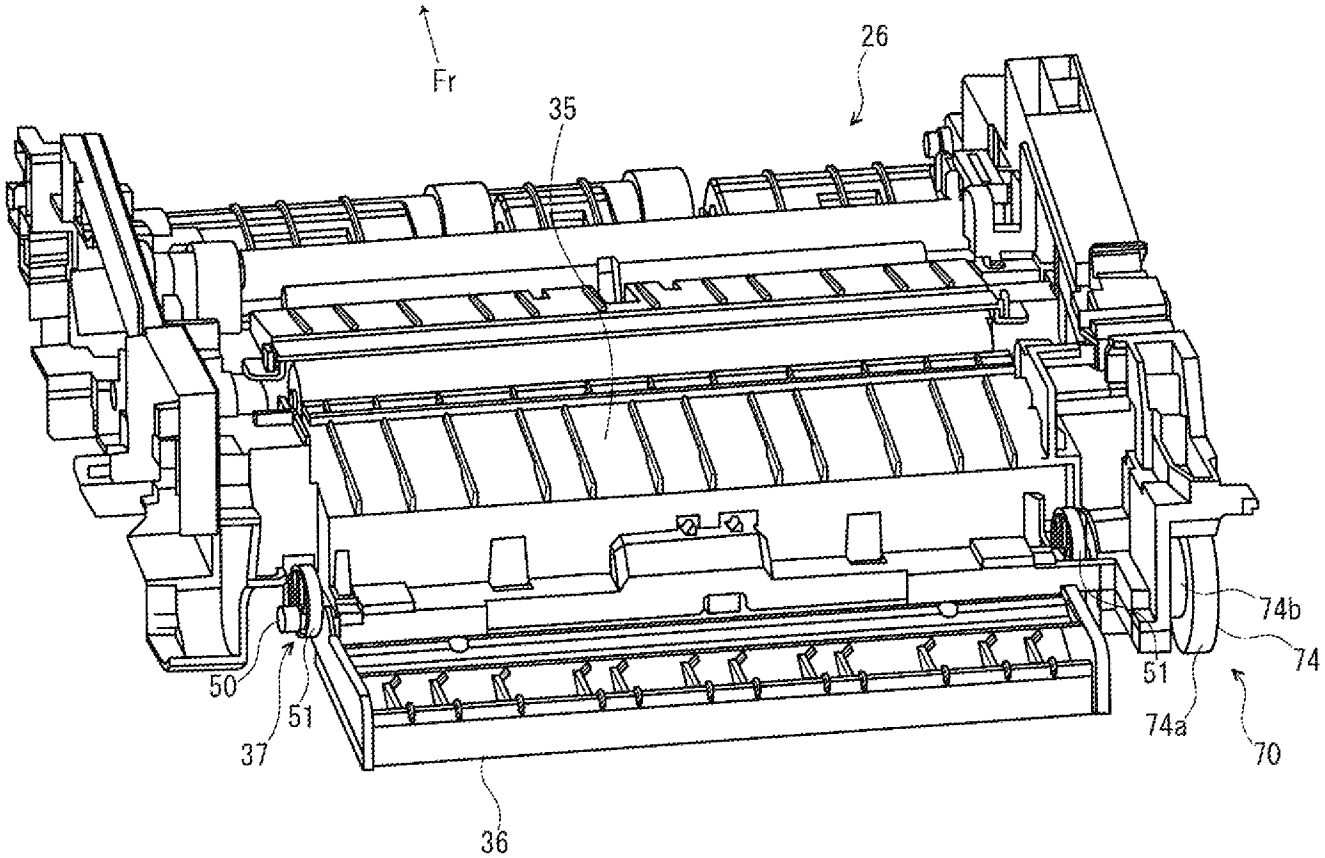
FIG. 5 is a perspective view showing a conveying unit in the printer according to the embodiment of the present disclosure.

As shown in FIG. 5, the conveying unit 26 is formed in a flat-liked shape lengthened in the left and right direction. As shown in FIG. 3, the conveying unit 26 includes an upper side conveying frame 35 and a lower side conveying frame 36 (a conveying frame for duplex printing) joined with each other, and a nip pressure changing member 37 disposed between the upper side conveying frame 35 and lower side conveying frame 36.

Between the upper side conveying frame 35 and lower side conveying frame 36, a shaft hole 38 is formed in the left and right direction. In the shaft hole 38, a plurality of upper side ribs 40 are located at predetermined intervals in the left and right direction and protruded from the upper side conveying frame 35 and a plurality of lower side ribs 41 are located at predetermined intervals in the left and right direction and protruded from the lower side conveying frame 36.

In the center of the shaft hole 38 in the left and right direction, a housing part 42 is arranged, and, in the housing part 42, a sensor 43 fixed onto the upper side conveying frame 35 is housed. The sensor 43 is, for example, a photo interrupter (PI) sensor and includes a light emitting part 44 and a light receiving part 45 faced to each other at a predetermined distance. In a left end of the upper side conveying frame 35, a supporting piece 47 is formed, and, in the supporting piece 47, a bearing hole 48 is bored in the left and right direction.

Figure 6:
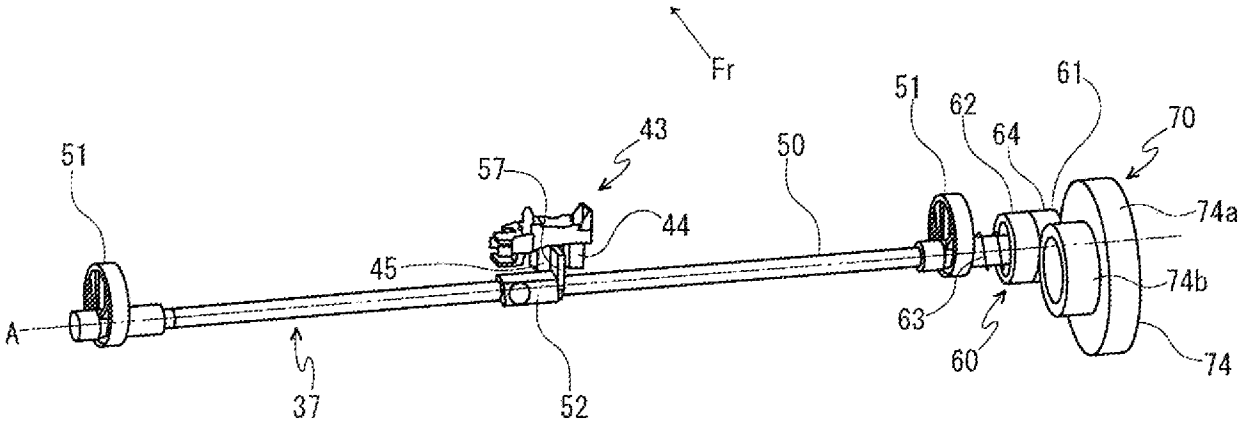
FIG. 6 is a perspective view showing a nip pressure changing member and a peripheral part thereof in the printer according to the embodiment of the present disclosure.

As shown in FIG. 6 and others, the nip pressure changing member 37 includes a straight rod-like shaft 50 extending in the right and left direction (horizontal direction), elliptical cams 51 fixed at right end part and left side part of the shaft 50, and a detection lever 52 fixed substantially at a center in the horizontal direction of the shaft 50.

The shaft 50 is made of metal for example. As shown in FIG. 3, the shaft 50 is inserted through the shaft hole 38 of the conveying unit 26, and the right and left end parts of the shaft 50 are exposed out of the conveying unit 26. The shaft 50 is provided such that it is sandwiched by upper side ribs 40 of the upper side conveying frame 35 and lower side ribs 41 of the lower side conveying frame 36. The right end part of the shaft 50 is pivotally supported by the shaft supporting part 33 provided in the right guide cassette 32, and the left end part of the shaft 50 is pivotally supported by the bearing hole 48 provided in the supporting piece 47 of the upper side conveying frame 35. Thereby, the nip pressure changing member 37 is supported by the printer main body 2 so as to be rotatable around a rotation axis A extending in the horizontal direction. That is, a rotation axis direction of the nip pressure changing member 37 is the horizontal direction in the present embodiment.

Figure 7:
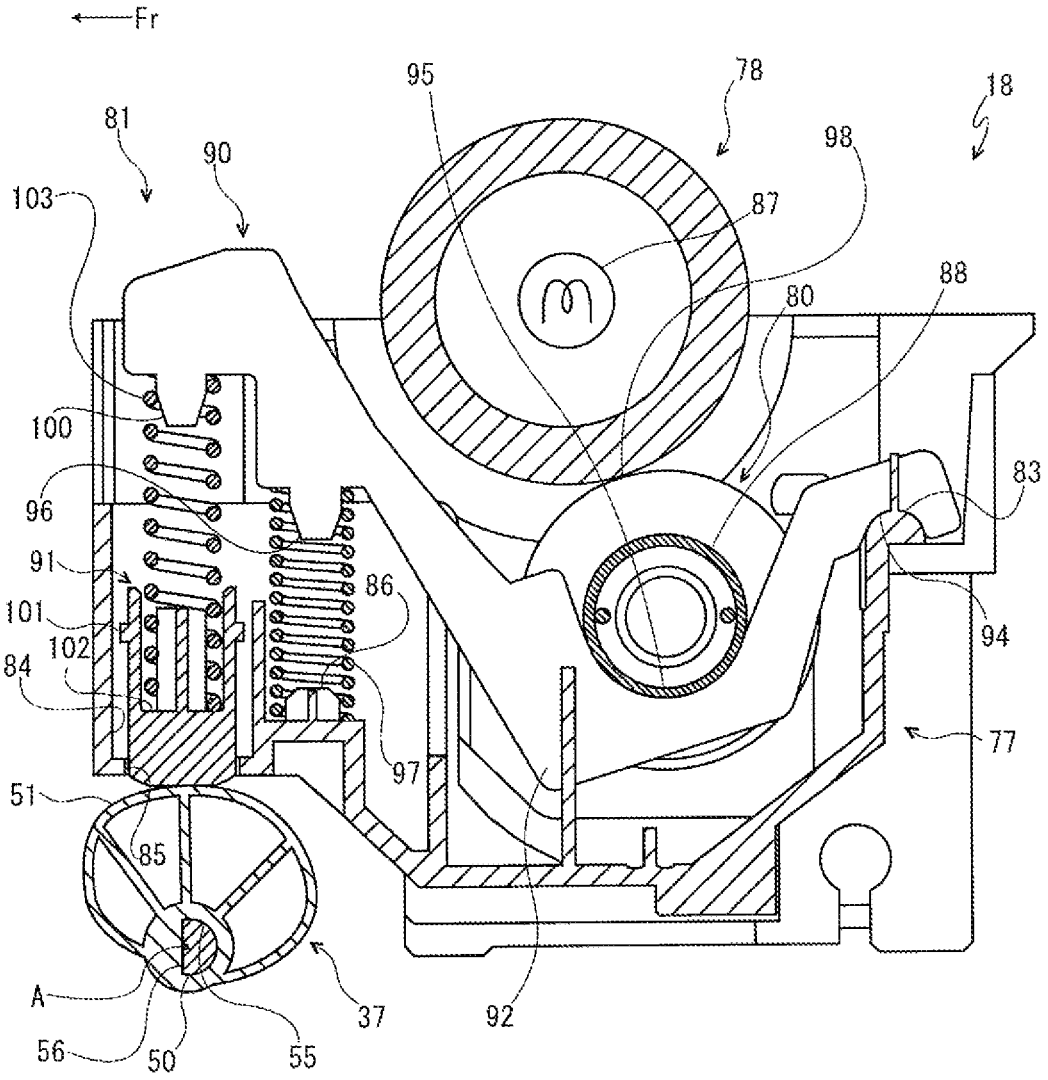
FIG. 7 is a sectional side view showing a state in which a cam is located at a press position in the printer according to the embodiment of the present disclosure.
Figure 8:
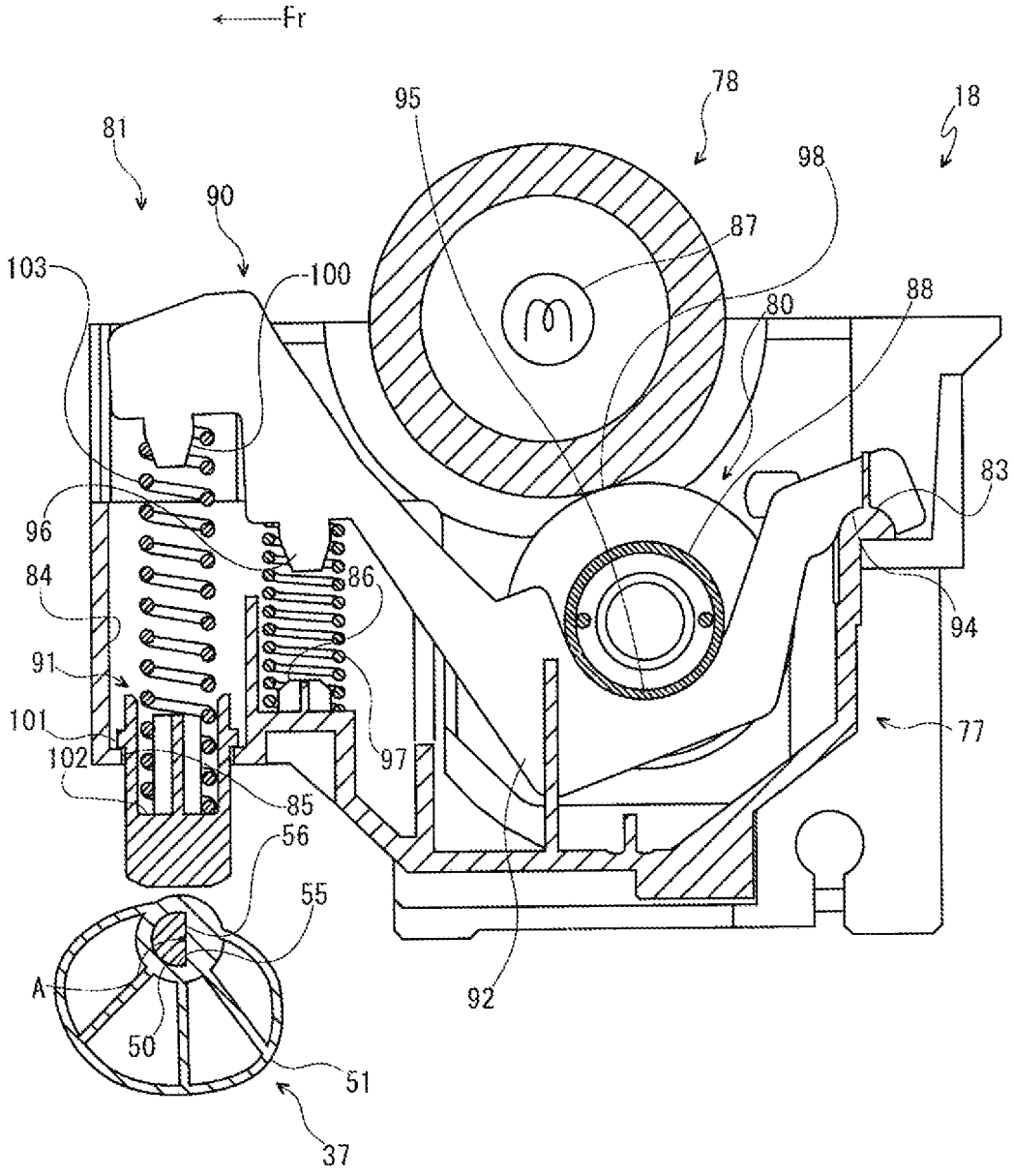
FIG. 8 is a sectional side view showing a state in which the cam is located at a press releasing position in the printer according to the embodiment of the present disclosure.
Figure 9A:
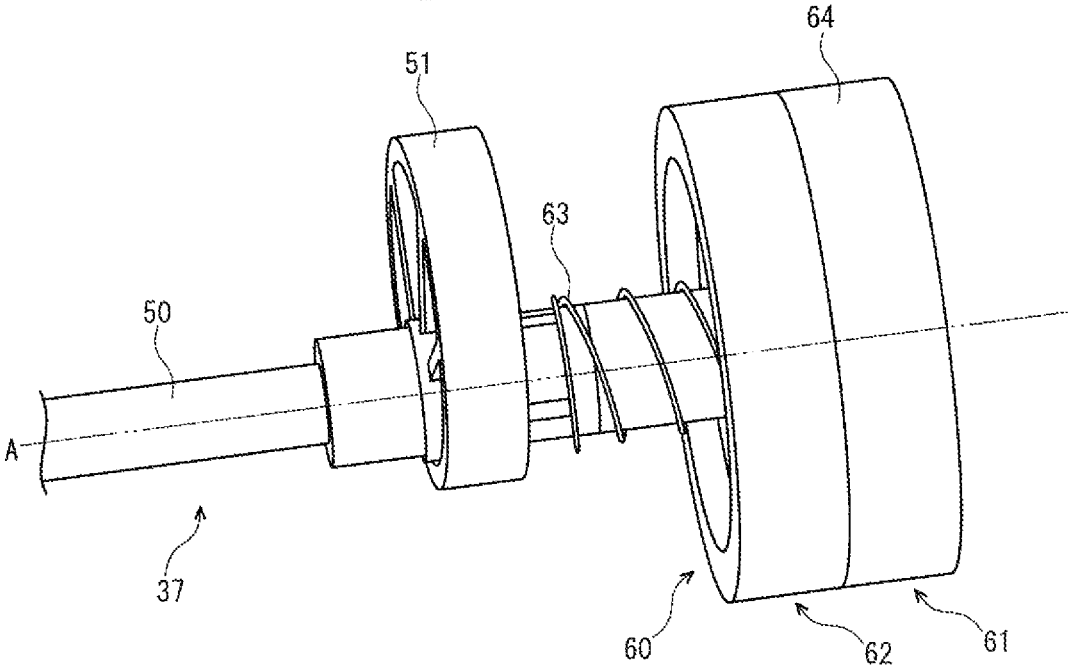
FIG. 9A is a perspective view showing a state in which a driven piece is located at an engage position in the printer according to the embodiment of the present disclosure.
Figure 9B:
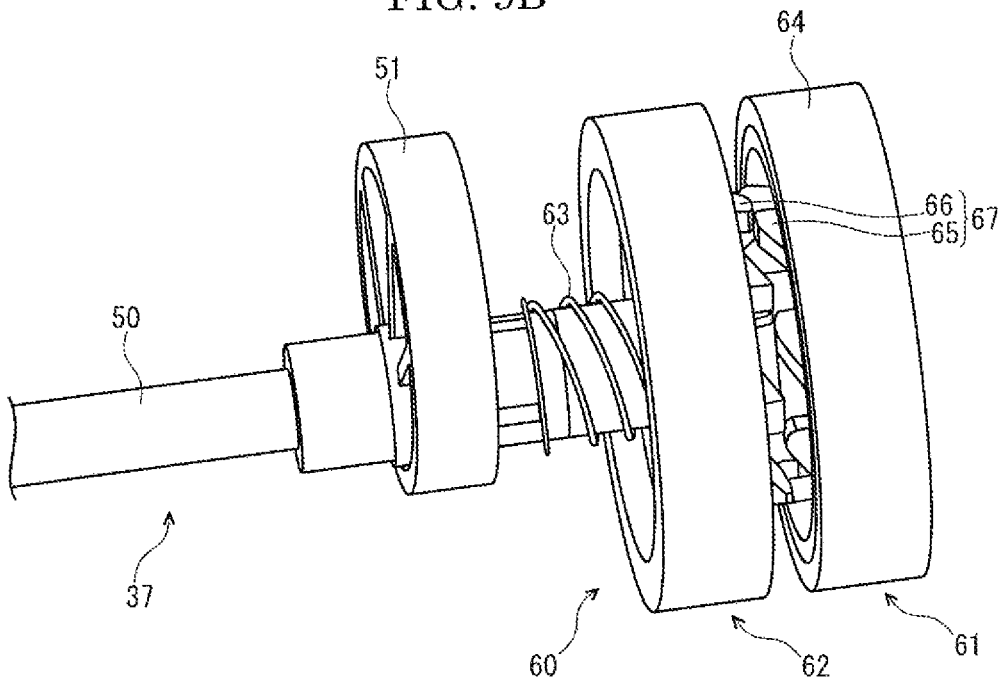
FIG. 9B is a perspective view showing a state in which the driven piece is located at an engage releasing position in the printer according to the embodiment of the present disclosure.

As shown in FIGS. 7 and 8, the left (right) cam 51 is provided with a fixing hole 55 formed into a shape of D, and the cam 51 is restricted from rotating relatively to the shaft 50 by inserting a fixing part 56 formed into a shape of D of the shaft 50 into the fixing hole 55. The cam 51 is configured to move between a press position (see FIG. 7) projecting upward from the shaft 50 and a press releasing position (see FIG. 8) moved downward from the press position along with a rotation of the nip pressure changing member 37.

As shown in FIG. 6 and others, the detection lever 52 is provided with a plate-like sensed object 57 extending in the vertical direction at a position corresponding to the sensor 43.

As shown in FIG. 6 and others, the nip pressure changing member 37 is provided with a clutch mechanism 60 at a left end side (right end side in terms of the drawing in FIG. 6) thereof. As shown in FIGS. 9 and 10, the clutch mechanism 60 includes a driving piece 61, a driven piece 62 provided on a right side (left side in FIGS. 9 and 10) of the driving piece 61, and a coil spring 63 (biasing member) provided on a right side (left side in FIGS. 9 and 10) of the driven piece 62.

The driving piece 61 is rotatably supported by the printer main body 2 and is provided coaxially with the shaft 50 of the nip pressure changing member 37. The driving piece 61 is provided with a driving gear 64 at an outer circumferential surface thereof.

As shown in FIG. 10, the driving piece 61 is provided with driving side ratchet teeth 65 at a surface facing the driven piece 62 continuously in a circumferential direction thereof. The driving side ratchet teeth 65 are provided with driving side first edge parts 65*a* formed along the horizontal direction and driving side second edge parts 65*b* inclined with respect to the horizontal direction. The driving side first edge parts 65*a* and driving side second edge parts 65*b* are formed alternately in the circumferential direction.

The driven piece 62 is provided with driven side ratchet teeth 66 at a surface facing the driving piece 61 continuously in the circumferential direction thereof. The driven side ratchet teeth 66 are provided with driven side first edge parts 66*a* formed along the horizontal direction and driven side second edge parts 66*b* inclined with respect to the horizontal direction. The driven side first edge parts 66*a* and driven side second edge parts 66*b* are formed alternately in the circumferential direction. The driven side ratchet teeth 66 compose a ratchet mechanism 67 together with the driving side ratchet teeth 65.

The driven piece 62 is slidable along the horizontal direction between an engage position (see FIGS. 9A and 10A) where the driving side ratchet teeth 65 are engaged with the driven side ratchet teeth 66 and an engage releasing position (see FIGS. 9B and 10B) where the engagement between the driving side ratchet teeth 65 and the driven side ratchet teeth 66 is released. That is, the driven side ratchet teeth 66 are capable of engaging with or disengaging from the driving side ratchet teeth 65. The driven piece 62 is provided around the shaft 50 of the nip pressure changing member 37 and is configured to rotate in a body with the nip pressure changing member 37. The driven piece 62 is provided coaxially with the shaft 50 of the nip pressure changing member 37.

As shown in FIG. 3, the coil spring 63 is interposed between the supporting piece 47 of the upper side conveying frame 35 and the driven piece 62 of the clutch mechanism 60. The coil spring 63 biases the driven piece 62 to the engage position (see FIGS. 9A and 10A).

Figure 11:
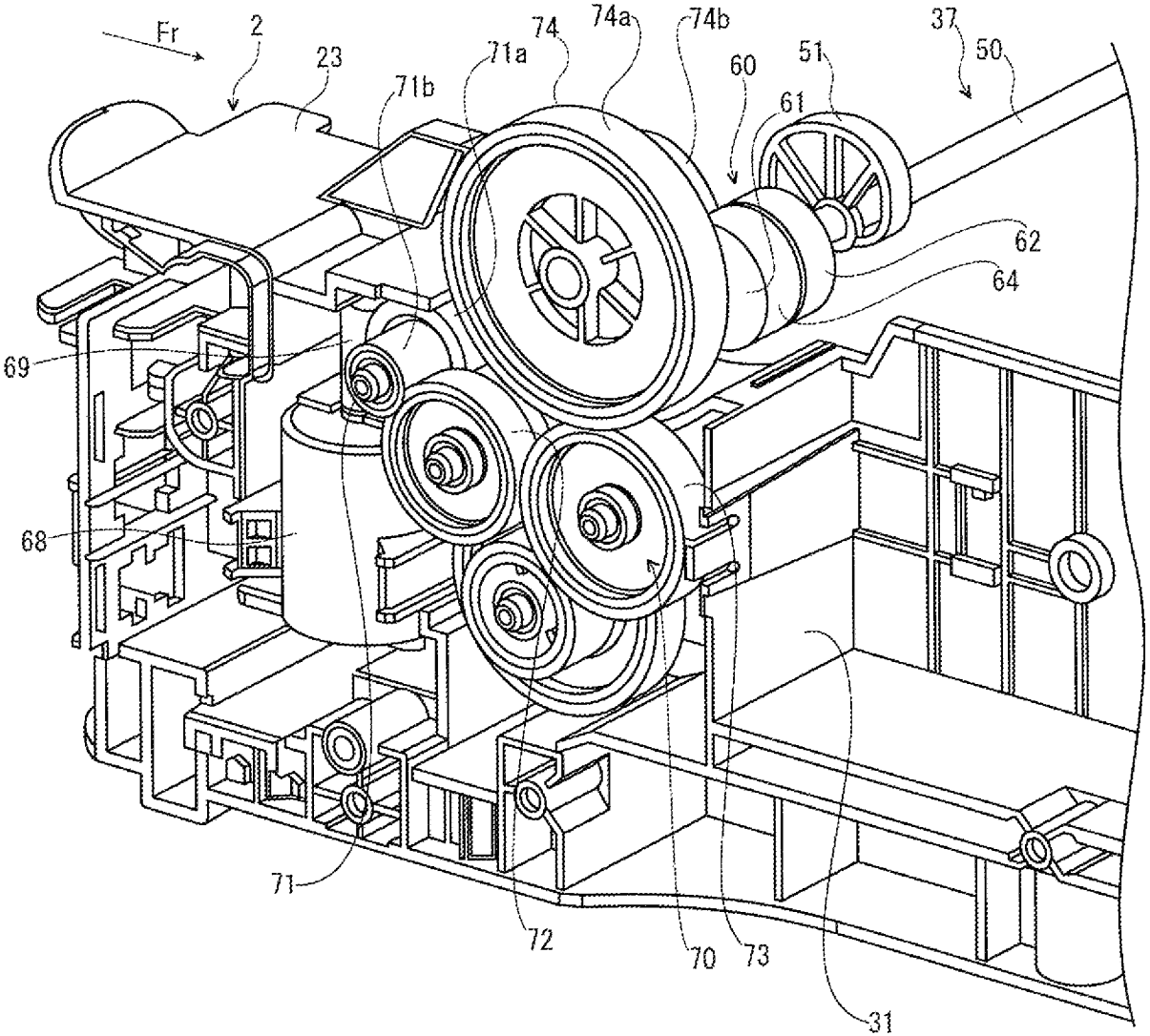
FIG. 11 is a perspective view showing a left guide cassette and a peripheral part thereof in the printer according to the embodiment of the present disclosure.

As shown in FIG. 11, a nip pressure changing motor 68 (driving source) is stored in the left guide cassette 31 of the printer main body 2. The nip pressure changing motor 68 includes a worm gear 69 extending upward and configured such that the worm gear 69 rotates as the nip pressure changing motor 68 drives.

A deceleration gear mechanism 70 is provided in front of the nip pressure changing motor 68 on the left guide cassette 31 of the printer main body 2. The deceleration gear mechanism 70 includes a first gear 71, a second gear 72 provided at a lower front side of the first gear 71, a third gear 73 provided at front side of the second gear 72, and a fourth gear 74 provided at an upper side of the third gear 73.

The first gear 71 includes a large diameter part 71*a* and a small diameter part 71*b*. The large diameter part 71*a* of the first gear 71 meshes with the worm gear 69 of the nip pressure changing motor 68. The second gear 72 meshes with the small diameter part 71*b* of the first gear 71. The third gear 73 meshes with the second gear 72. The fourth gear 74 includes a large diameter part 74*a* and a small diameter part 74*b*. The large diameter part 74*a* of the fourth gear 74 meshes with the third gear 73. The small diameter part 74*b* of the fourth gear 74 meshes with the driving gear 64 provided on the driving piece 61 of the clutch mechanism 60. As it is apparent from the above description, the deceleration gear mechanism 70 connects the nip pressure changing motor 68 with the clutch mechanism 60.

Next, the fixing unit 18 will be described. The fixing unit 18 is detachably installed to the fixing unit installed part 34 (refer to FIG. 4) of the printer main body 2.

As shown in FIG. 7 and others, the fixing unit 18 includes a box-formed fixing frame 77, a heating roller 78 (a first rotating member), a pressing roller 80 (a second rotating member) and fixing nip forming mechanisms 81. The heating roller 78 and pressing roller 80 are housed in the fixing frame 77. The pressing roller 80 faces the heating roller 78. The fixing nip forming mechanisms 81 are respectively located onto left and right ends of the heating roller 78 and pressing roller 80.

In left and right ends in a rear end part of the fixing frame 77, engaged objects 83 are formed in semicircular arc-liked shapes curved upward. In left and right ends in a front end parts of the fixing frame 77, holder housings 84 extending in the upper and lower direction are formed, and, in a lower end part of each holder housing 84, an inserting hole 85 is bored in the upper and lower direction. In the fixing frame 77, fixing frame side spring receptions 86 are provided behind the respective holder housings 84.

The heating roller 78 is formed in a lengthened shape in the left and right direction. The heating roller 78 includes, for instance, a cylinder-formed core member, an elastic layer provided around the core member and a release layer covering the elastic layer. The core member of the heating roller 78 is, for example, made of metal, such as aluminum or iron. The elastic layer of the heating roller 78 is, for example, made of silicon rubber or the like. The release layer of the heating roller 78 is, for example, made of fluororesin, such as per fluoro alkoxy (PFA). Left and right ends of the heating roller 78 are rotatably supported in the fixing frame 77. In internal space of the heating roller 78, a heater 87 (a heating source) is housed. The heater 87 is configured by, for example, a halogen heater or ceramic heater.

The pressing roller 80 is formed in a lengthened shape in the left and right direction. The pressing roller 80 includes, for instance, a cylinder-formed core member, an elastic layer provided around the core member and a release layer covering the elastic layer. The core member of the pressing roller 80 is, for example, made of metal, such as aluminum or iron. The elastic layer of the pressing roller 80 is, for example, made of silicon rubber or the like. The release layer of the pressing roller 80 is, for example, made of fluororesin, such as per fluoro alkoxy (PFA). On left and right ends of the pressing roller 80, bearings 88 are attached.

The right (left) fixing nip forming mechanism 81 includes a pressurizing member 90 housed in the left and right ends of the fixing frame 77 and a spring holder 91 located below and in front of the pressurizing member 90.

The pressurizing member 90 is formed by sheet metal and includes a bend part 92 in the center in the forward and backward direction so as to be formed roughly in an L-shape. In a rear end of the pressurizing member 90, a semicircular arc-liked engaging part 94 is formed. The engaging part 94 engages with the engaged object 83 formed in the fixing frame 77, thereby supporting the pressurizing member 90, in a rotatable state around a side of the engaging part 94 (a rear side in the embodiment), onto the fixing frame 77. In a rear part of the pressurizing member 90, a holding part 95 is formed, and, on the right (left) holding part 95, the right end (left end) of the pressing roller 80 is rotatably held by the holding part 95 via the respective bearing 88.

In a front part of the pressurizing member 90, a first spring reception 96 is formed. The first spring reception 96 is located on the opposite side of the engaging part 94 across the holding part 95. Between the first spring reception 96 and fixing frame side spring receptions 86 of the fixing frame 77, a first spring 97 configured by a coil spring is installed. The first spring 97 is a constitutional component of the left (right) fixing nip forming mechanisms 81. The first spring 97 biases the pressurizing member 90 upward, and accordingly, the pressurizing member 90 adds pressure to the pressing roller 80 in the direction toward the heating roller 78. Thereby, the pressing roller 80 is brought into pressure contact with the heating roller 78 to form a fixing nip 98 between the heating roller 78 and pressing roller 80. When the sheet passes through the fixing nip 98, the toner image is fixed on the sheet. In a front end of the pressurizing member 90, a second spring reception 100 is formed. The second spring reception 100 is located on the opposite side of the engaging part 94 across the holding part 95 and located at a position further away from the engaging part 94 than the first spring reception 96.

The spring holder 91 is installed in an upward/downward movable state in the holder housing 84 formed in the fixing frame 77. The spring holder 91 is inserted into the inserting hole 85 bored in the holder housing 84. A lower end of the spring holder 91 is exposed below the fixing frame 77 and is located right above the cam 51 provided in the nip pressure changing member 37 of the printer main body 2. On the circumference of an upper part of each spring holder 91, a circular engaging protrusion 101 is formed.

On an upper surface side of each spring holder 91, a holder side spring reception 102 extending in the upper and lower direction is arranged. Between the holder side spring reception 102 and second spring reception 100 of the pressurizing member 90, a second spring 103 configured by a coil spring is installed. The second spring 103 is a constitutional component of the left (right) fixing nip forming mechanisms 81.

Figure 12:
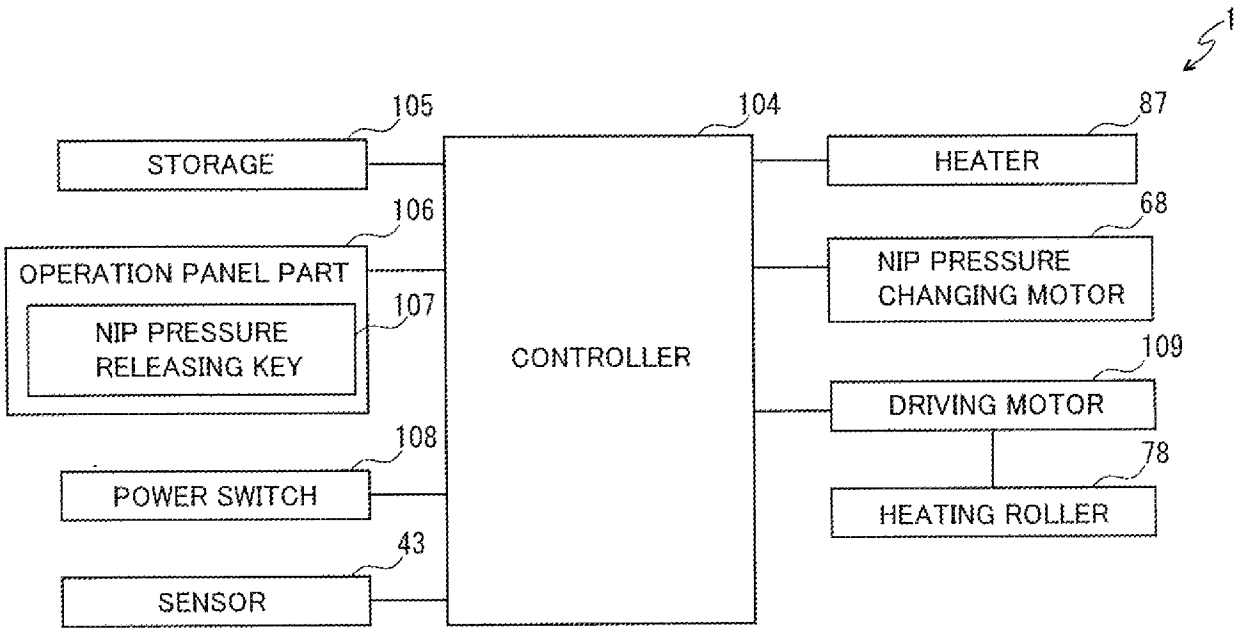
FIG. 12 is a block diagram showing a configuration of the printer according to the embodiment of the present disclosure.

Next, mainly with reference to FIG. 12, a controlling system of the printer 1 will be described.

The printer 1 is provided with a controller 104. The controller 104 is connected with a storage 105 configured by a storing device, such as ROM (Read Only Memory) or RAM (Random Access Memory). The controller 104 controls components of the printer 1 on the basis of control programs and control data stored in the storage 105. The controller 104 is also configured to control a conveyance speed of the sheet to the fixing nip 98.

The controller 104 is connected with an operation panel part 106 arranged on the printer main body 2. The operation panel part 106 is provided with operation keys, such as a start key, a stop/clear key, and numeric keys, and is provided with a touch panel. When a user handles the operation keys or the touch panel, an instruction according to the handling is outputted to the controller 104. The operation panel part 106 is provided with a nip pressure releasing key 107 along with the abovementioned operation keys. The nip pressure releasing key 107 is, for example, displayed by switching a screen of the operation panel part 106 to the user setting screen.

The controller 104 is connected with a power switch 108 to turn on a main power of the printer 1.

The controller 104 is connected with the sensor 43. When the sensor 43 senses a position of the sensed object 57 attached on the detection lever 52 of the nip pressure changing member 37, a sensing signal from the sensor 43 is outputted to the controller 104.

The controller 104 is connected with a heater 87. The heater 87 is electrified on the basis of a signal from the controller 104 to heat the heating roller 78.

The controller 104 is connected with the nip pressure changing motor 68. The nip pressure changing motor 68 drives on the basis of a drive instructing signal from the controller 104. The controller 104 is connected with the heating roller 78 via a driving motor 109. The driving motor 109 makes the heating roller 78 rotate on the basis of a drive instructing signal from the controller 104.

In the fixing unit 18 constructed as described above, an operation for changing the nip pressure in fixing a toner image on a sheet will be explained first.

As shown in FIG. 8, the cam 51 of the nip pressure changing member 37 is located at the press releasing position and the cam 51 does not press the spring holder 91 in a state before the printer 1 is turned on. A distance from a lower end part of the holder side spring reception 102 of the spring holder 91 to the second spring reception 100 is longer than a natural length of the second spring 103. Due to that, a bias force of the second spring 103 does not act on the pressurizing member 90, and the pressurizing member 90 presses the pressing roller 80 to the heating roller 78 side only by a bias force of the first spring 97. A nip pressure at this time will be denoted as P1 hereinafter.

When a power switch 108 is operated and a main power of the printer 1 is turned on in this state, the nip pressure changing motor 68 drives and the worm gear 69 rotates on a basis of a drive instructing signal from the controller 104. When the worm gear 69 thus rotates, this rotation is transmitted to the driving piece 61 of the clutch mechanism 60 through the deceleration gear mechanism 70, and the driving piece 61 rotates in one direction with respect to the driven piece 62 as indicated by an arrow B in FIG. 10A. Along with this rotation, the driving side first edge parts 65*a* provided in the driving side ratchet teeth 65 of the driving piece 61 press the driven side first edge parts 66*a* provided in the driven side ratchet teeth 66 of the driven piece 62. With this pressure, the driven piece 62 rotates by 180 degrees together with the driving piece 61. At this time, the driven piece 62 is kept at the engage position by the bias force of the coil spring 63.

Figure 10A:
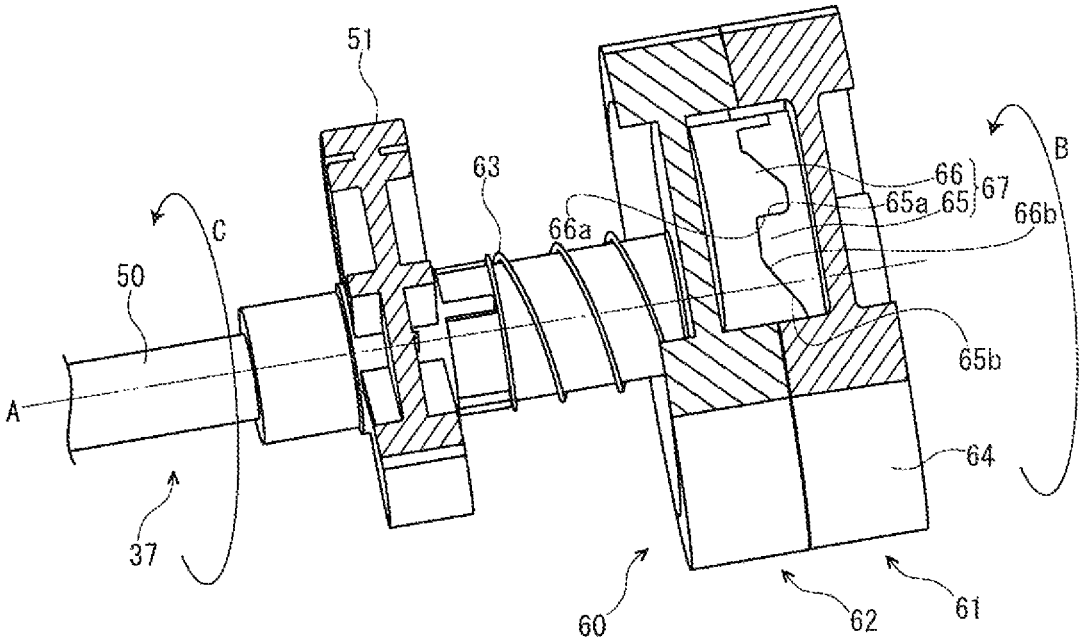
FIG. 10A is a sectional perspective view showing a state in which the driven piece is located at the engage position in the printer according to the embodiment of the present disclosure.
Figure 10B:
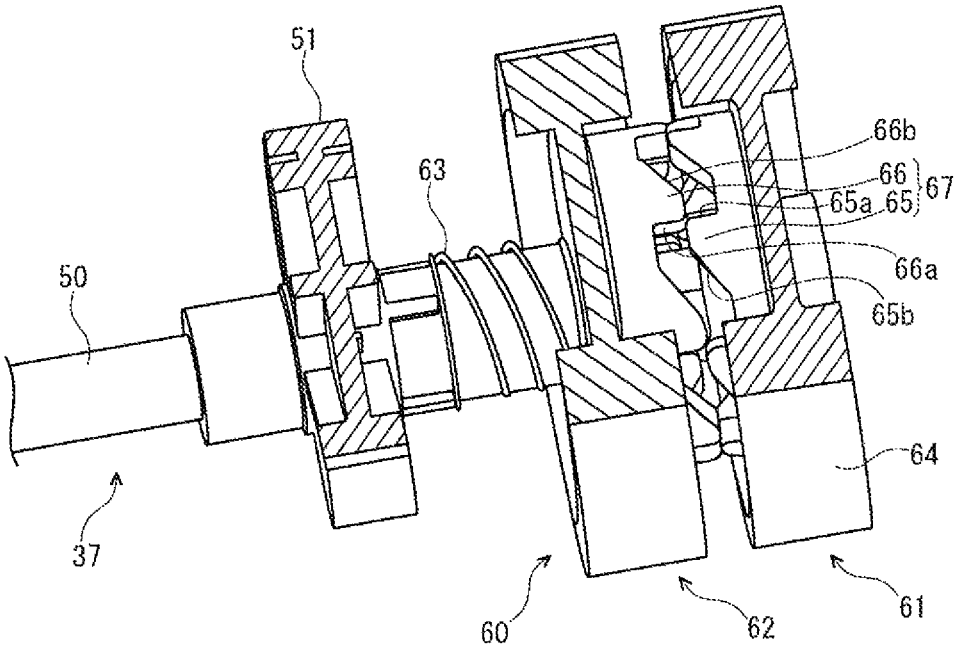
FIG. 10B is a sectional perspective view showing a state in which the driven piece is located at the engage releasing position in the printer according to the embodiment of the present disclosure.

When the driven piece 62 rotates by 180 degrees as described above, the nip pressure changing member 37 rotates by 180 degrees together with the driven piece 62 as indicated by an arrow C in FIG. 10A. Along with that, the cams 51 of the nip pressure changing member 37 move from the press releasing position to the press position as shown in FIG. 7 and presses the lower end part of the spring holder 91 upward. Due to this pressure, the spring holder 91 moves in a direction approaching to the second spring reception 100 (upward in the present embodiment) and presses the second spring reception 100 upward through the second spring 103. Along with that, the pressurizing member 90 rotates upward around the engaging part 94 side, the pressing roller 80 approaches the heating roller 78, and the pressing roller 80 stops at a position where a pressing force applied from the pressurizing member 90 to the pressing roller 80 balances with a resilience force of the elastic layer of the pressing roller 80. Along with that, the nip pressure switches to P2 which is greater than P1. At this time, not only the bias force of the second spring 103 but also the bias force of the first spring 97 acts on the pressurizing member 90.

Figure 13:
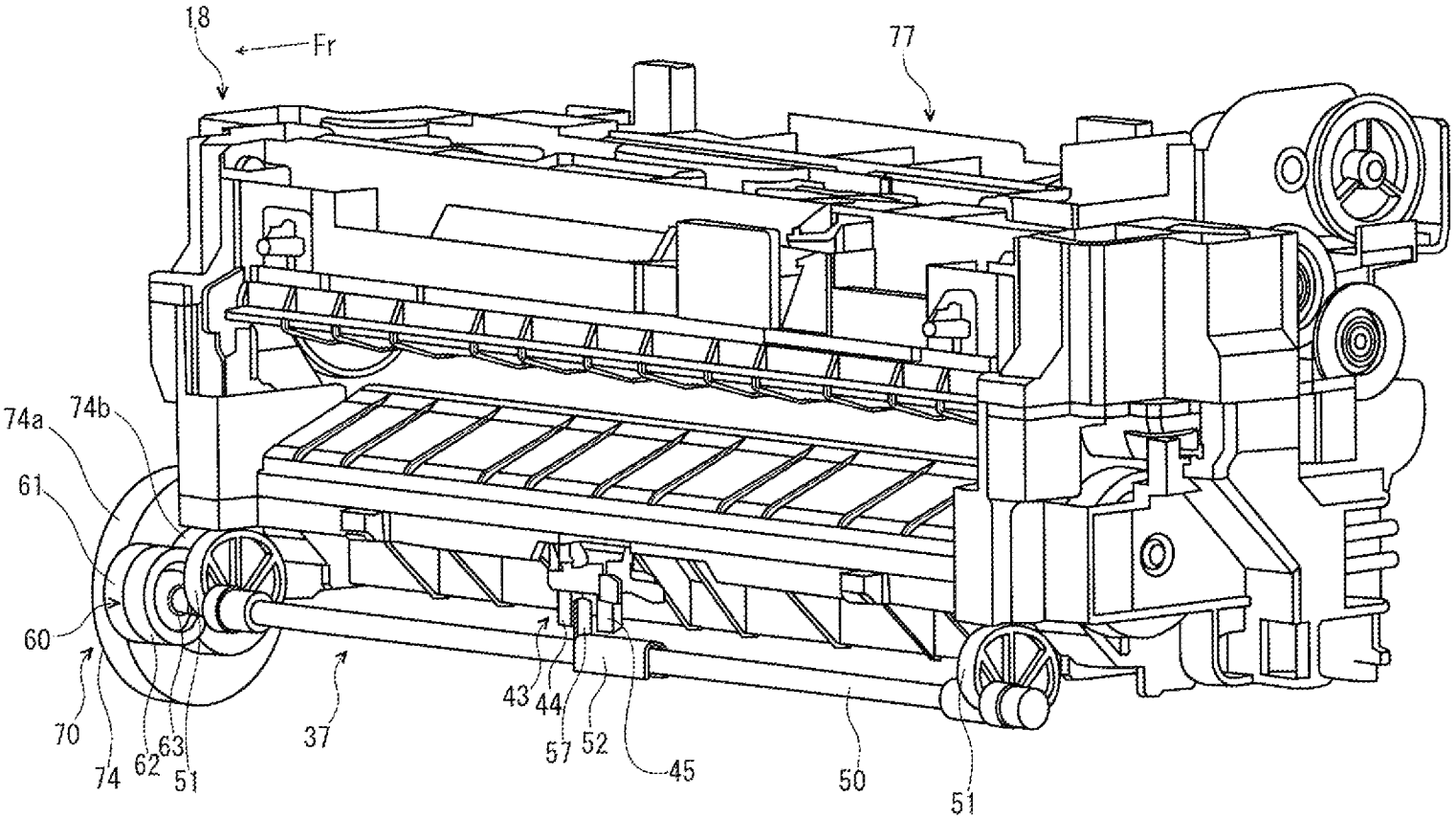
FIG. 13 is a perspective view showing a state in which the fixing unit is installed to the printer main body and the cam is located at the press position in the printer according to the embodiment of the present disclosure.

Next, when the nip pressure changing member 37 is turned by 180 degrees as described above, the sensed object 57 provided on the detection lever 52 of the nip pressure changing member 37 enters between the light emitting part 44 and the light receiving part 45 of the sensor 43 as shown in FIG. 13. Thereby, the sensor 43 detects the rotation of the nip pressure changing member 37 and outputs the sensing signal to the controller 104.

In the state of the nip pressure P2, a toner image is fixed to a sheet such as a plain sheet. At this time, the sheet is conveyed to the fixing nip 98 with a normal speed by being controlled by the controller 104.

Meanwhile, if a toner image is fixed to a sheet such as an envelope and a thin sheet with the nip pressure P2, there is fear that the sheet is wrinkled or a conveying performance of the sheet is lowered because the nip pressure is too strong. Then, the nip pressure releasing key 107 of the operation panel part 106 is operated in such a case.

When the instruction of the operation is outputted from the operation panel part 106 to the controller 104, the nip pressure changing motor 68 drives and the worm gear 69 rotates on the basis of the drive instructing signal outputted of the controller 104. When the worm gear 69 thus rotates, this rotation is transmitted to the driving piece 61 of the clutch mechanism 60 through the deceleration gear mechanism. 70 and the driving piece 61 rotates in one direction with respect to the driven piece 62 as indicated by the arrow B in FIG. 10A. Along with that, the driven piece 62 rotates by 180 degrees in a body with the driving piece 61 similarly to the case when the main power of the printer 1 is turned on. When the driven piece 62 thus rotates by 180 degrees, the nip pressure changing member 37 rotates by 180 degrees in a body with the driven piece 62 as indicated by the arrow C in FIG. 10A.

Along with that, the cam 51 of the nip pressure changing member 37 moves from the press position to the press releasing position as shown in FIG. 8, and the pressure applied to the spring holder 91 by the cam 51 is released. Along with that, the spring holder 91 drops by its own weight and the engaging protrusion 101 of the spring holder 91 abuts against the holder housing 84 around the inserting hole 85. Thereby, the bias force of the second spring 103 does not act on the pressurizing member 90 and the nip pressure is reduced from P2 to P1.

A width of the fixing nip 98 is thus narrowed when the nip pressure is reduced from P2 to P1, there is a possibility that the toner image is not fixed fully to the sheet if the sheet is conveyed to the fixing nip 98 with the same speed with the case of the nip pressure P2. Then, in this case, the sheet is conveyed to the fixing nip 98 with a speed slower than the normal speed by being controlled by the controller 104. This makes it possible to prolong a time during which the sheet passes through the fixing nip 98 and to fix the toner image reliably to the sheet.

Figure 14:
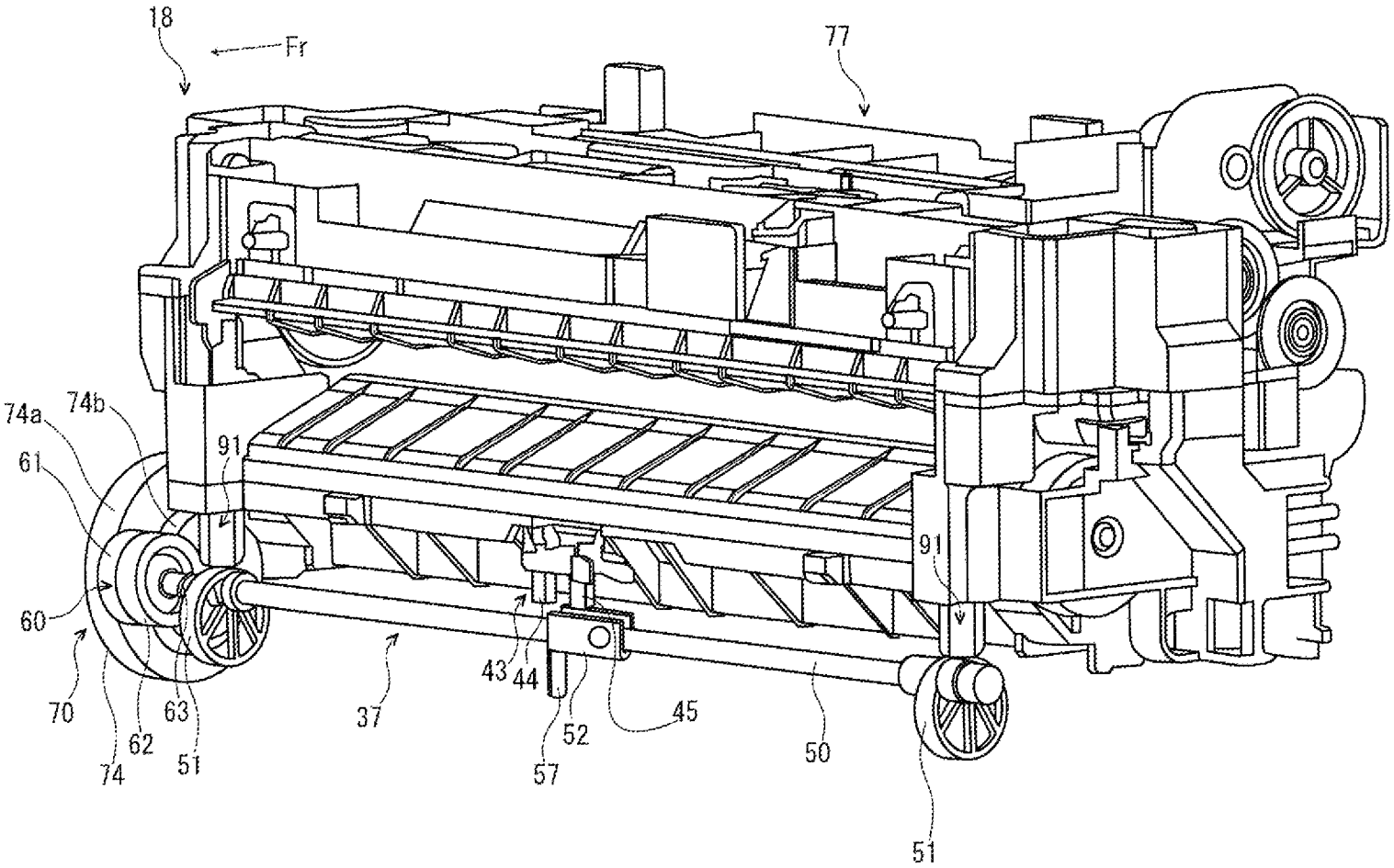
FIG. 14 is a perspective view showing a state in which the fixing unit is installed to the printer main body and the cam is located at the press releasing position in the printer according to the embodiment of the present disclosure.

When the nip pressure changing member 37 rotates by 180 degrees as described above, the sensed object 57 provided on the detection lever 52 of the nip pressure changing member 37 separates from the part between the light emitting part 44 and the light receiving part 45 of the sensor 43 as shown in FIG. 14. Along with that, the sensor 43 detects the rotation of the nip pressure changing member 37 and outputs a sensing signal to the controller 104.

It is noted that when no operation of fixing the toner image to the sheet is carried out, e.g., a standby time, the state in which the cam 51 is located at the press releasing position is kept in consideration that a plain sheet is used more frequently than an envelope and a thin sheet. In contrary, it is also possible to keep the state in which the cam 51 is located at the press releasing position (the state of the nip pressure P1) as a matter of course.

As described above, according to the present embodiment, the clutch mechanism 60 is configured so as to permit the transmission of the rotation from the nip pressure changing motor 68 to the nip pressure changing member 37. Due to that, it is possible to automatically change the nip pressure by rotating the nip pressure changing member 37 by the nip pressure changing motor 68.

The nip pressure changing member 37, the nip pressure changing motor 68, and the clutch mechanism 60 are provided not in the fixing unit 18 but in the printer main body 2. Due to that, it is possible to simplify the configuration of the fixing unit 18, to cut a number of parts and a manufacturing cost thereof, and to compact a size of the fixing unit 18. Still further, because the nip pressure changing member 37 is provided in the printer main body 2, it is possible to receive the large load generated while changing the nip pressure by the printer main body 2. Therefore, it is possible to prevent the excessive load from being applied to the fixing unit 18 and to improve stability of the nip pressure changing operation.

Still further, because the nip pressure changing member 37 is provided on the outside of the fixing unit 18, a margin in terms of a layout is produced within the fixing unit 18. Thereby, the distances from the engaging part 94 to the first spring reception 96 and the second spring reception 100 can be prolonged, so that it is possible to increase a lever ratio. Along with that, spring pressures of the first spring 97 and the second spring 103 can be reduced.

The distance between the heating roller 78 and the pressing roller 80 is regulated by the spring pressures of the first spring 97 and the second spring 103. Due to that, it is possible to flexibly vary the distance between the heating roller 78 and the pressing roller 80 as compared to a case where only one spring is employed.

The second spring reception 100 is disposed at a position farther from the engaging part 94 than the first spring reception 96. Therefore, it is possible to prolong the distance from the second spring reception 100 to the engaging part 94 as compared to a case where the second spring reception 100 is disposed at a position closer to the engaging part 94 than the first spring reception 96. Along with that, it is possible to reduce the spring pressure of the second spring 103 further.

The shaft hole 38 is formed between the upper and lower side conveying frames 35 and 36. Due to that, it is possible to sandwich the shaft 50 by the upper and lower side conveying frames 35 and 36 and to prevent the shaft 50 from deflecting.

Next, a method for installing/detaching the fixing unit 18 to/out of the printer main body 2 will be explained.

In installing/detaching the fixing unit 18 to/out of the printer main body 2, normally a nip pressure releasing key 107 of the operation panel part 106 is operated before detaching the fixing unit 18 out of the printer main body 2. When the nip pressure releasing key 107 is operated, the controller 104 rotates the nip pressure changing member 37 by the nip pressure changing motor 68. By this rotation, the cam 51 moves from the press position to the press releasing position and the pressure applied to the spring holder 91 by the cam 51 is released (see FIG. 14). The fixing unit 18 is detached out of the printer main body 2 in this state, and a repaired fixing unit 18 or a new fixing unit 18 is installed to the printer main body 2.

However, in a case where the operation of the nip pressure releasing key 107 as described above is not made before detaching the fixing unit 18 out of the printer main body 2, a case where the power source of the printer 1 is cut, e.g., a power code is pulled out, in the state in which the cam 51 is located at the press position, or a case where a trouble such as jamming occurs and the operation panel part 106 is locked in the state in which the cam 51 is located at the press position, the installation/detachment of the fixing unit 18 is carried out in the state in which the cam 51 is located at the press position.

Figure 15:
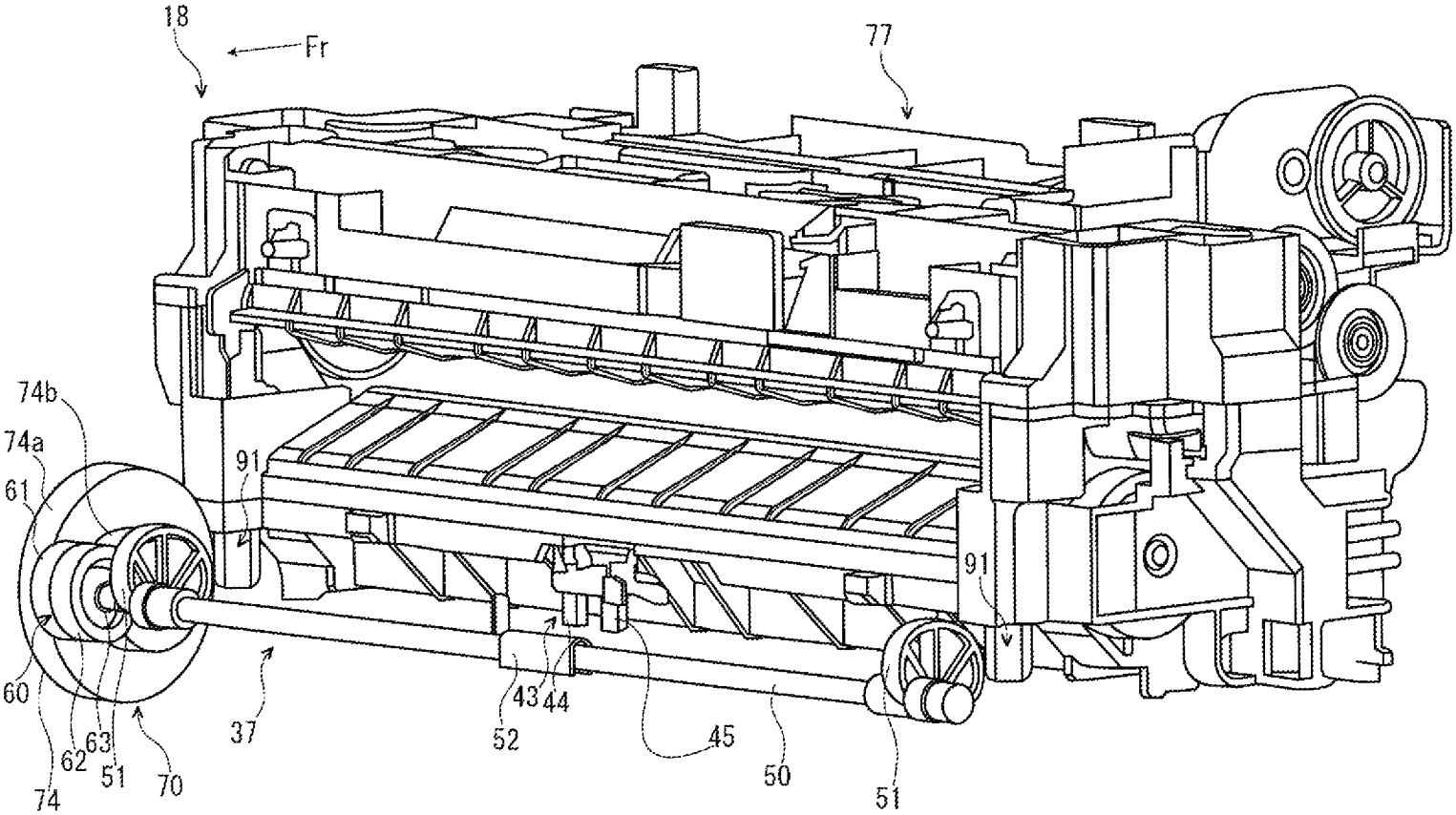
FIG. 15 is a perspective view showing a state in which the fixing unit is to be just installed to the printer main body in the state in which the cam is located at the press position in the printer according to the embodiment of the present disclosure.

When the repaired fixing unit 18 or the new fixing unit 18 is installed to the printer main body 2 in such a case, the spring holder 91 abuts against the cam 51 which is located at the press position and the spring holder 91 presses the cam 51 as shown in FIG. 15. When the cam 51 is thus pressed, the nip pressure changing member 37 rotates as indicated by the arrow C shown in FIG. 10A and the cam 51 moves from the press position to the press releasing position.

When the nip pressure changing member 37 rotates as described above, the driven piece 62 rotates with respect to the driving piece 61. Along with that, the driven side second edge parts 66*b* provided in the driven side ratchet teeth 66 of the driven piece 62 are pressed in the right direction (in the left direction in FIG. 10A) by the driving side second edge parts 65*b* provided in the driving side ratchet teeth 65 of the driving piece 61. Along with that, the driven piece 62 slides from the engage position to the engage releasing position against the bias force of the coil spring 63, so that the transmission of the rotation from the driven piece 62 to the driving piece 61 is restricted, and the driving piece 61 keeps a rotation stopped state. Due to that, the worm gear 69 of the nip pressure changing motor 68 and the respective gears 71 through 74 of the deceleration gear mechanism 70 also keep the rotation stopped state.

As described above, in the present embodiment, the transmission of the rotation from the nip pressure changing member 37 to the nip pressure changing motor 68 is restricted by the clutch mechanism 60. Due to that, it is possible to rotate the nip pressure changing member 37 without rotating the worm gear 69 of the nip pressure changing motor 68 and the respective gears 71 through 74 of the deceleration gear mechanism 70 when the nip pressure changing motor 68 is stopped. Accordingly, it is possible to rotate the nip pressure changing member 37 with less torque as compared to the case of rotating the nip pressure changing member 37 together with the worm gear 69 of the nip pressure changing motor 68 and the respective gears 71 through 74 of the deceleration gear mechanism 70.

The clutch mechanism 60 is composed of the driving piece 61, the driven piece 62 and the coil spring 63 as described above. Thus, it is possible to realize the clutch mechanism 60 by the simple structure.

The ratchet mechanism 67 having the driving and driven side ratchet teeth 65 and 66 is also provided as described above. This configuration makes it possible to reliably transmit the rotation of the driving piece 61 to the driven piece 62 and to reliably prevent the rotation of the driven piece 62 from being transmitted to the driving piece 61.

In the present embodiment, when the fixing unit 18 is installed to the printer main body 2 in the state in which the cam 51 is located at the press position, the spring holder 91 presses the cam 51, the nip pressure changing member 37 rotates, and the cam 51 moves from the press position to the press releasing position. Due to that, it is possible to move the cam 51 from the press position to the press releasing position in linkage with the operation of installing the fixing unit 18 to the printer main body 2.

Normally, the nip pressure changing member 37 rotates by operating the nip pressure releasing key 107 and the cam 51 moves from the press position to the press releasing position. An adoption of such configuration makes it possible to readily change the nip pressure by operating the operation panel part 106 and to reduce a burden of the operator such as a user and a serviceman.

Figure 16:
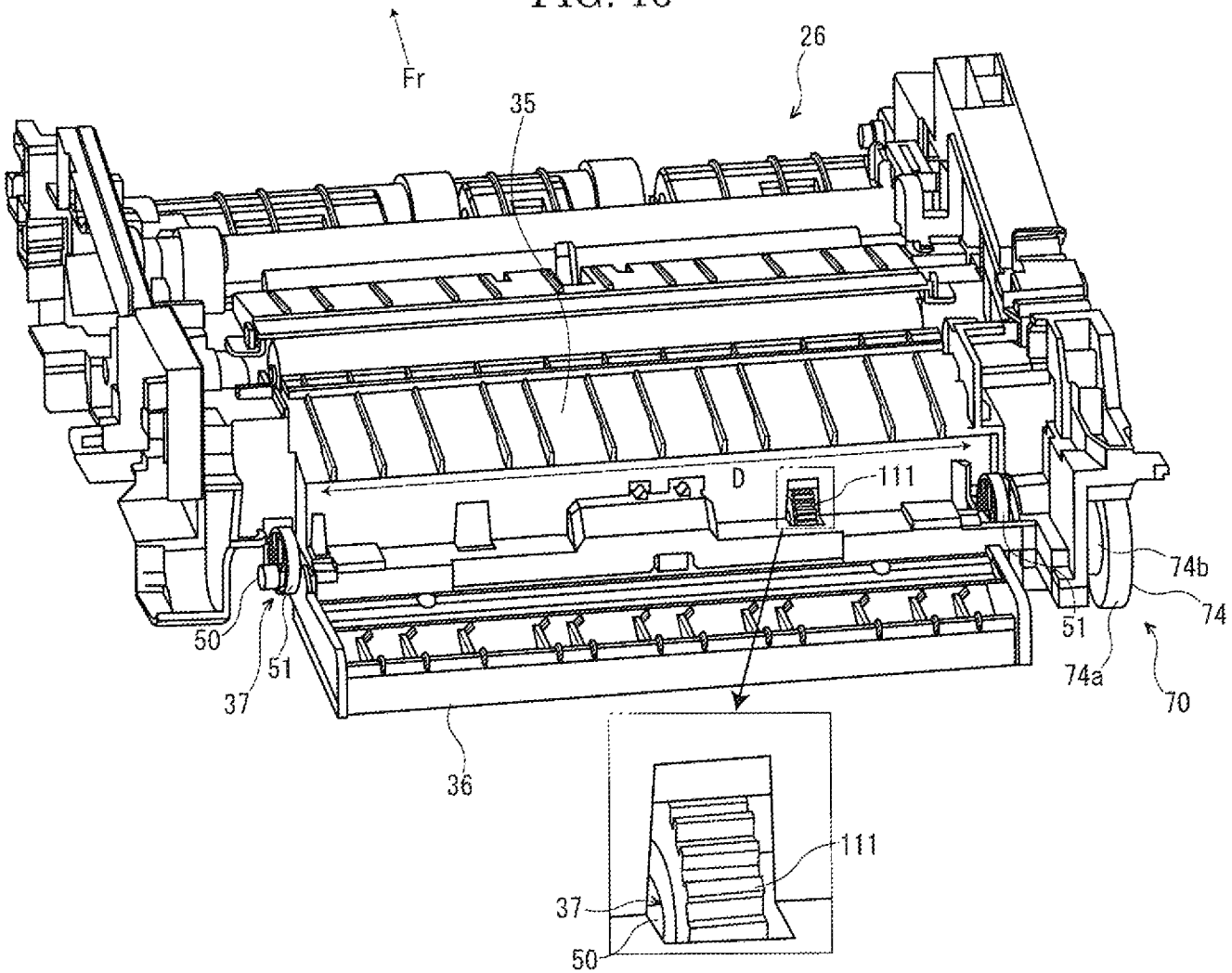
FIG. 16 is a perspective view showing a conveying unit in the printer according to another embodiment of the present disclosure.

In the present embodiment, the spring holder 91 presses the cam 51, the nip pressure changing member 37 rotates, and the cam 51 moves from the press position to the press releasing position when the fixing unit 18 is installed to the printer main body 2 in the state in which the cam 51 is located at the press position. In another embodiment, as shown in FIG. 16, an operation part 111 may be fixed to the shaft 50 of the nip pressure changing member 37. If the operation part 111 is operated in the state in which the cam 51 is located at the press position, the nip pressure changing member 37 rotates and the cam 51 moves from the press position to the press releasing position. An adoption of such configuration makes it possible to move the cam 51 from the press position to the press releasing position at any timing when the nip pressure changing motor 68 is stopped.

It is noted that the operation part 111 is provided between a pair of cams 51 and is disposed within a sheet conveying area D as shown in FIG. 16. Meanwhile, in another embodiment, the operation part 111 is disposed out of the sheet conveying area D by providing the operation part 111 on an outside of the pair of cams 51. In a still different embodiment, the cam 51 and the detection lever 52 may be rotated manually without providing the operation part 111.

In still another embodiment, the controller 104 may control such that the nip pressure changing motor 68 rotates the nip pressure changing member 37 and the cam 51 rotates from the press position to the press releasing position when the power switch 108 is operated and the main power is turned on in the state in which the cam 51 is located at the press position. An adoption of such configuration makes it possible to automatically reduce the nip pressure from P2 to P1 when the main power is turned on. Therefore, it is possible to change the nip pressure even in a case when a failure is informed (so-called a serviceman call) and the operation panel part 106 is locked. In this case, the nip pressure changing member 37 may be rotated by the nip pressure changing motor 68 when a print signal is inputted to the controller 104 and the nip pressure may be changed from the pressure P1 to the pressure P2.

In the embodiment, the shaft 50 is made of metal. In another embodiment, a shaft 50 may be made of resin. The quality of the material of a shaft 50 may be selected for each type of the machine, for instance, a high-end type of a machine (a high speed machine) with a great load on the shaft 50 is provided with a metal shaft, while a low-end type of another machine (a low speed machine) with a lower load on the shaft 50 than the high-end type is provided with another resinous shaft. In the embodiment, because the shaft 50 is attached to the printer main body 2 instead of the fixing unit 18, even if the quality of the material of a shaft 50 is selected for each type of the machine, the common fixing unit 18 can be applied to the different types of the machines.

In the embodiment, the right end part of the shaft 50 is pivotally supported by the right guide cassette 32 attached on the right main body frame 24 of the printer main body 2 and the left end part of the shaft 50 is pivotally supported by the upper side conveying frame 35 of the conveying unit 26. On the other hand, in a further embodiment, both ends of the shaft 50 may be pivotally supported by the left and right main body frames 23 and 24 of the printer main body 2 or by the conveying unit 26.

In the embodiment, the fixing nip forming mechanism 81 of so-called "a spring pressure controlling type" having the first spring 97 and second spring 103 is used. On the other hand, in a furthermore embodiment, a fixing nip forming mechanism of so-called "a shaft center distance controlling type" configured to control a shaft center distance between the first rotating member and second rotating member may be used.

In the embodiment, the nip pressure is changed between the pressures P1 and P2. In another embodiment, the nip pressure may be changed among three or more pressures.

In the embodiment, the heating roller 78 is applied as the first rotating member and the pressing roller 80 is applied as the second rotating member. On the other hand, in a further embodiment, the first or second rotating member may be configured by a belt.

In the embodiment, the heater 87 is applied as a heating source. In a furthermore embodiment, another heating source, such as an IH coil or the like may be applied.

The embodiment was described in a case where ideas of the disclosure are applied to the printer 1. On the other hand, in another embodiment, the ideas of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a fixing unit including a first rotating member heated by a heating source, a second rotating member facing the first rotating member, and a fixing nip forming mechanism forming a fixing nip between the first rotating member and second rotating member by bringing the second rotating member into pressure contact with the first rotating member;

an apparatus main body to which the fixing unit is detachably installed;

a nip pressure changing member configured to press the fixing nip forming mechanism and to change a pressure of the fixing nip by rotating around a rotation axis;

a driving source that rotates the nip pressure changing member; and a clutch mechanism configured to permit a transmission of a rotation from the driving source to the nip pressure changing member and to restrict a transmission of a rotation from the nip pressure changing member to the driving source, wherein the clutch mechanism includes;

a driving piece configured to rotate along with a rotation of the driving source;

a driven piece being slidable along the rotation axis direction between an engage position where the driven piece engages with the driving piece and an engage releasing position where the engagement of the driven piece with the driving piece is released, and rotating in a body with the nip pressure changing member; and a biasing member configured to bias the driven piece to the engage position, wherein when the driving piece rotates with respect to the driven piece, the driven piece rotates in a body with the driving piece as the driven piece is kept at the engage position by a bias force of the biasing member, when the driven piece rotates with respect to the driving piece, the driving piece keeps a rotation stopped state as the driven piece slides from the engage position to the engage releasing position against the bias force of the biasing member.

2. The image forming apparatus according to claim 1, further comprising a ratchet mechanism, wherein the ratchet mechanism includes:

driving side ratchet teeth provided in the driving piece; and driven side ratchet teeth provided in the driven piece and engaging with or disengaging from the driving side ratchet teeth.

3. The image forming apparatus according to claim 2, wherein the driving side ratchet teeth include driving side first edge parts provided along the rotation axis direction and driving side second edge parts inclined with respect to the rotation axis direction, the driving side first and second edge parts being formed alternately in a circumferential direction, and the driven side ratchet teeth include driven side first edge parts provided along the rotation axis direction and driven side second edge parts inclined with respect to the rotation axis direction, the driven side first and second edge parts being formed alternately in the circumferential direction.

4. The image forming apparatus according to claim 1, wherein the driving and driven pieces are provided coaxially with the nip pressure changing member.

5. The image forming apparatus according to claim 1, further comprising a pair of conveying frames joined with each other, wherein the nip pressure changing member is disposed between the pair of conveying frames, and the biasing member is interposed between one of the conveying frame and the driven piece.

6. The image forming apparatus according to claim 1, wherein the nip pressure changing member is provided in the apparatus main body.

7. An image forming apparatus comprising:

a fixing unit including a first rotating member heated by a heating source, a second rotating member facing the first rotating member, and a fixing nip forming mechanism forming a fixing nip between the first rotating member and second rotating member by bringing the second rotating member into pressure contact with the first rotating member;

an apparatus main body to which the fixing unit is detachably installed;

a nip pressure changing member configured to press the fixing nip forming mechanism and to change a pressure of the fixing nip by rotating around a rotation axis;

a driving source that rotates the nip pressure changing member; and a clutch mechanism configured to permit a transmission of a rotation from the driving source to the nip pressure changing member and to restrict a transmission of a rotation from the nip pressure changing member to the driving source, wherein the nip pressure changing member is provided in the apparatus main body, and the nip pressure changing member includes:

a shaft extending in the rotation axis direction; and a cam fixed to the shaft and moving between a press position where the cam presses the fixing nip forming mechanism and a press releasing position where the pressure applied to the fixing nip forming mechanism by the cam is released; wherein when the fixing unit is installed to the apparatus main body in a state in which the cam is located at the press position, the fixing nip forming mechanism presses the cam and the nip pressure changing member rotates and the cam moves from the press position to the press releasing position.

8. The image forming apparatus according to claim 1, wherein the nip pressure changing member includes:

a shaft extending in the rotation axis direction;

a cam fixed to the shaft and moving between a press position where the cam presses the fixing nip forming mechanism and a press releasing position where the pressure applied to the fixing nip forming mechanism by the cam is released; and an operation part fixed to the shaft, wherein when the operation part is operated in the state in which the cam is located at the press position, the nip pressure changing member rotates and the cam moves from the press position to the press releasing position.

9. An image forming apparatus comprising:

a fixing unit including a first rotating member heated by a heating source, a second rotating member facing the first rotating member, and a fixing nip forming mechanism forming a fixing nip between the first rotating member and second rotating member by bringing the second rotating member into pressure contact with the first rotating member;

an apparatus main body to which the fixing unit is detachably installed;

a nip pressure changing member configured to press the fixing nip forming mechanism and to change a pressure of the fixing nip by rotating around a rotation axis;

a driving source that rotates the nip pressure changing member;

a clutch mechanism configured to permit a transmission of a rotation from the driving source to the nip pressure changing member and to restrict a transmission of a rotation from the nip pressure changing member to the driving source;

an operation panel part having a nip pressure releasing key; and a controller causing the driving source to rotate the nip pressure changing member and to release the pressure applied to the fixing nip forming mechanism by the nip pressure changing member when the nip pressure releasing key is operated in a state in which the nip pressure changing member presses the fixing nip forming mechanism.

10. The image forming apparatus according to claim 1, further comprising:

a power switch to turn on a main power; and a controller causing the driving source to rotate the nip pressure changing member and to release the pressure applied to the fixing nip forming mechanism by the nip pressure changing member when the power switch is operated to turn on the main power in a state in which the nip pressure changing member presses the fixing nip forming mechanism.

11. The image forming apparatus according to claim 1, further comprising a deceleration gear mechanism connecting the driving source with the clutch mechanism.

* * * * *